United States Patent [19]

Reil

[11] 4,223,789

[45] Sep. 23, 1980

[54] OPENING MEANS FOR A PACKAGING MEANS OF FLEXIBLE MATERIAL

[75] Inventor: Wilhelm Reil, Bensheim-Auerbach, Fed. Rep. of Germany

[73] Assignee: Tetra Pack Developpement S.A., Pully, Switzerland

[21] Appl. No.: 972,049

[22] Filed: Dec. 21, 1978

[30] Foreign Application Priority Data

Dec. 24, 1977 [DE] Fed. Rep. of Germany ..... 2758092

[51] Int. Cl.[2] ..... B65D 5/72

[52] U.S. Cl. ..... 206/605; 229/17 R

[58] Field of Search ..... 229/17 R, 7 R; 206/605

[56] References Cited

U.S. PATENT DOCUMENTS

| | | | |
|---|---|---|---|
| 3,650,458 | 3/1972 | Rausing | 229/17 R |
| 3,883,034 | 5/1975 | Rausing | 229/7 R X |
| 3,900,155 | 8/1975 | Rausing et al. | 229/17 R X |
| 3,977,591 | 8/1976 | Martensson et al. | 229/7 R |
| 4,113,103 | 9/1978 | Carlsson | 229/7 R |
| 4,126,263 | 11/1978 | Martensson | 229/17 R |

FOREIGN PATENT DOCUMENTS

| | | | |
|---|---|---|---|
| 1536319 | 7/1971 | Fed. Rep. of Germany . | |
| 2407175 | 8/1975 | Fed. Rep. of Germany | 229/17 R |

*Primary Examiner*—Stephen P. Garbe

*Attorney, Agent, or Firm*—Biebel, French & Nauman

[57] ABSTRACT

An approximately U-shaped slot is provided in the side wall adjacent the edge line, to form a pouring edge which projects from the edge line and which can be pivoted forwardly into the plane of the upper end wall, wherein the pouring opening and the slot are provided with a plastics sealing means from the inside of the package, the free ends of the U-shaped slot are arranged to extend by a portion into the upper end wall, and the outer cover strip is weld-free almost over the entire pouring edge region.

5 Claims, 5 Drawing Figures

OPENING MEANS FOR A PACKAGING MEANS OF FLEXIBLE MATERIAL

Figure 1:
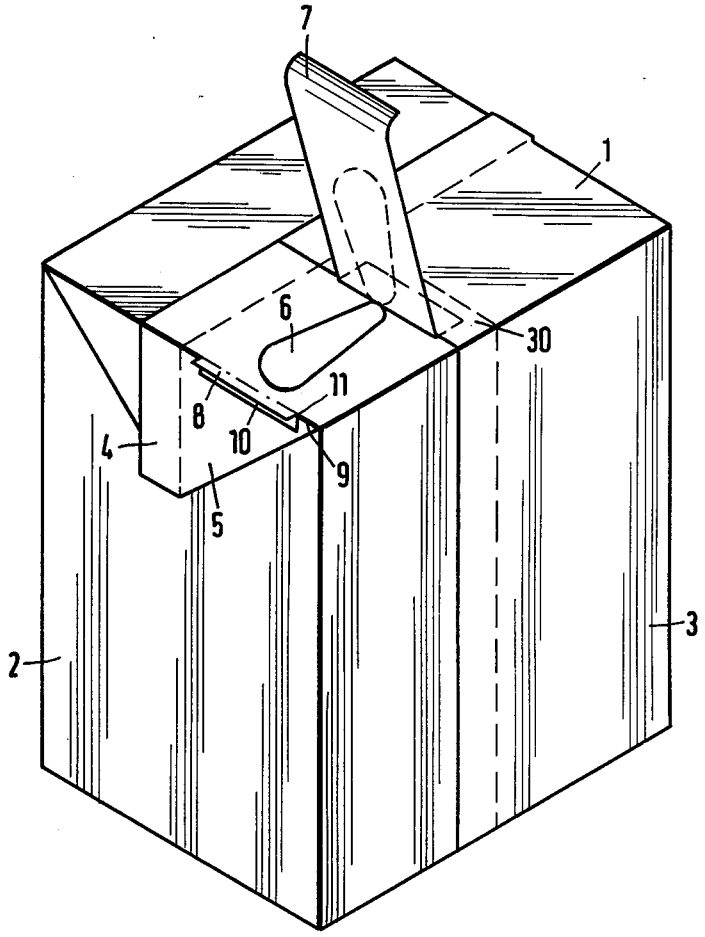

The invention relates to an opening means for a package made from flexible material, in particular for liquids, having a pouring opening in its upper end wall adjacent an edge line and having an openable cover strip which is disposed on the outside.

The invention is described with reference to a package which is used for liquid foodstuffs, that is to say, dairy products such as milk and cream or also fruitjuices and the like, for one-trip use. The packages are made from web-form laminate material which usually has a main layer of paper or foam material which has a homogenous layer of thermoplastic material on both sides. The packages are formed by folding the web-form laminate material and are sealed by heating and compressing the marginal zones of the folded laminate material, thereby producing liquid-tight and relatively stable packaging means, for example of a square shape. The invention however is not limited to this configuration.

Milk cartons of parallelepipedic shape or square shape are known, comprising side walls, an upper end wall and a bottom. Provided in the upper end wall is an opening which, to facilitate emptying the contents of the carton, is disposed at an edge line which separates the upper wall surface from the adjacent side surface of the carton. In order to facilitate pouring out the contents of the carton, the pouring opening is of an elongate or oval form and is so oriented that the major axis of the pouring opening extends primarily perpendicularly to the above-mentioned edge line of the carton. This makes it possible for air to be sucked into the carton at the same time as the contents of the carton are being emptied therefrom, the air which is drawn in replacing the contents which have been poured out and ensuring that the contents flow out of the carbon in a regular, compact and tidy stream. A cover strip of plastics material completely seals off the pouring opening. The cover strip can be torn off by way of an upwardly projecting end, thus opening the pouring opening. It is found that when pouring out a completely full carton, the flow of liquid being poured out separates and part runs down the side wall. In the known cartons, this is primarily because the edge line which is formed when shaping the carton by folding along a bending line and over which the contents of the carton run is slightly rounded and is not of a sufficiently sharp configuration that the flow of liquid from the carton 'comes away from' the outside surface of the carton.

Another package is known, in which, to solve this problem, a separate strip of material is provided on the front narrow side wall, adjacent the edge line of the packaging means, in order to provide a clearly marked pouring edge so that the flow of liquid out of the package extends somewhat beyond the original edge line of the package. Manufacturing such a package is however complicated and the strip is easily damaged.

The invention is therefore based on the problem of further developing the opening means of the kind described above, in such a way that, while being easy to manufacture, it ensures an opening procedure which satisfactorily provides that, when the outer cover strip is torn up, the pouring edge is folded out and forwardly into the plane of the upper end wall, and is protected from damage when this is done.

According to the invention, this problem is solved in that an approximately U-shaped slot is provided in the side wall adjacent the edge line, to form a pouring edge which projects from the edge line and which can be pivoted forwardly into the plane of the upper end wall, wherein the pouring opening and the slot are provided with a plastics sealing means from the inside of the package, the free ends of the U-shaped slot are arranged to extend by a portion into the upper end wall, and the outer cover strip is weld-free almost over the entire pouring edge region.

In addition, in accordance with the invention, the region from the outer pouring edge beyond the edge line to the pouring opening is substantially weld-free so that any liquid which clings thereto cannot penetrate into and soften the carrier material. Only one or more small fastening points ensure that the cover strip is secured to the upper cover wall or the front side wall.

The slot is of a U-shaped configuration, with the web portion which joins the two free limb portions of the U-shape being considerably longer than the limb portions themselves, and the free ends of the limb portions terminating at the edge line. According to the invention, the free ends of the limb portions of the U-shape extend beyond the edge line between the side wall and the upper end wall, and indeed extend by a distance into the end wall. In this respect it is preferable for about 40 to 90% and particularly desirably from 60 to 80% of the length of the limb portions of the U-shape to be disposed in the upper end wall so that the web portion of the slot, which joins the limb portions and which extends parallel to the edge line, is arranged very closely beside the edge line. This makes it possible for the pouring edge to be easily folded forwardly into the plane of the upper end wall. While a package having the opening means according to the invention is easy to produce, the features according to the invention provide for a reliable opening and pouring function because the flow which is poured out of the package over the sharp edge of the cut line can break away from the material of the package and therefore no longer runs down the wall of the package.

In an advantageous further embodiment of the invention, the outer cover strip is joined beside the slot to the pouring edge at at least one weld position. In order to ensure that the pouring edge, that is to say, the region within the U-shaped slot, can be folded out into the plane of the upper end wall, when the carrier materials used are not sufficiently resilient, the outer cover strip is welded to the pouring edge at at least one fastening position. When then the cover strip is torn up, the pouring edge, that is to say, the region in the U-shaped slot, is also raised while the weld position is being broken apart and until the weld position is finally separated, whereby the forward folding movement of the pouring edge into the plane of the upper end wall is assisted.

It is also advantageous in accordance with the invention for the outer cover strip to be welded by its end which is remote from the pouring edge, at a seal seam which is approximately in the middle of the upper end wall. This feature may be desirably used with advantage particularly where the package has a seal seam extending parallel to the edge line approximately in the middle region of the upper end wall. It is then possible for one end, namely the end of the cover strip which is associated with the middle of the upper end wall, to be welded in between two layers of packaging material. This is preferably not done over the entire depth of the seal seam, but is advantageously effected only in the region of a third of its width or alternatively outside of the seal seam itself, with a separate seal seam being provided in the region of the connecting strip, for usually a narrower sealing seam of for example only 2 mm in width is provided in the considerably wider connecting strip, which in some embodiments is for example 8 mm. By providing a separate seal seam in the connecting strip beside the seal seam which is provided for sealingly closing the package, the sealing conditions are improved and the seal seam which provides for sealing of the package then remains undisturbed, in other-words, no thickened portions are produced in making the seal seam, by virtue of the cover strip having been secured in position. It is known that thickened portions are always a potential risk of leakage.

It is also advantageous for the plastics sealing strip which is sealed on the inside of the package to have regions which are weld-free around the U-shaped slot and on the right and left sides of the end of the pouring opening which is towards the pouring edge. For reasons of sealing, the U-shaped slot itself must be sealed inwardly of the packaging means and is therefore covered with the sealing strip which is of plastics material. It is sufficient however for the sealing strip to be welded around the slot at a distance therefrom, and it is not desirable for the weld regions to extend directly over the slot as otherwise problems occur with regard to sealing and in addition the formation of the pouring edge is not of a comparably good quality.

According to the invention, it is also particularly advantageous for the outer cover strip to be welded at at least one weld position on the side wall which is adjacent the edge line and/or on a triangular flap which adjoins the edge line. The cover strip, which can be torn off in an upward direction, then adheres satisfactorily in the region of the pouring opening, when the packaging means is filled and sealed, and covers the pouring edge without the entire region under the outer cover strip also being welded thereto. The above-mentioned region then remains undamaged on its surface, after the cover strip has been torn away in an upward direction.

The legal requirements in some countries are that one-trip articles must only be in one piece. The invention, with the outer cover strip secured in the seal seam in the upper end wall, complies with this requirement in its full mode of functioning. The cover strip can indeed be torn upwardly, thus liberating the pouring edge and opening the pouring opening, but in this case it cannot be torn away as it then remains hanging from the packaging means. After the packaging means has been emptied, there is therefore only a single article to throw away, namely the empty packaging means and the cover strip which is clinging thereto.

It is desirable for the outer cover strip to be made from a thick aluminium or another metal foil. After the packaging means has been opened and possibly only partly emptied, the cover strip can then be folded downwardly and forwardly again over the pouring edge. To improve the situation from the point of view of hygiene, the cover strip not only covers the pouring edge, but, because of its metal properties, can also be bent around the pouring edge so that it forms a kind of re-closable pouring spout.

The opening means according to the invention can be provided in the most widely varying packaging means, in particular for liquids, irrespective of whether the packaging means have a transverse seal seam at the top or whether the transverse seal seam is provided in conjunction with a seal seam which extends normal thereto or whether no seal seam at all is provided in the upper end wall. The pouring opening itself, like the U-shaped slot, is preferably produced by punching when the packaging material is in the web form, before folding and shaping the packaging means. The sealing strip is advantageously sealed in position from the inside after the punching operation, and similarly for the operations of fastening and sealing the outer cover strip in place.

Figure 2:
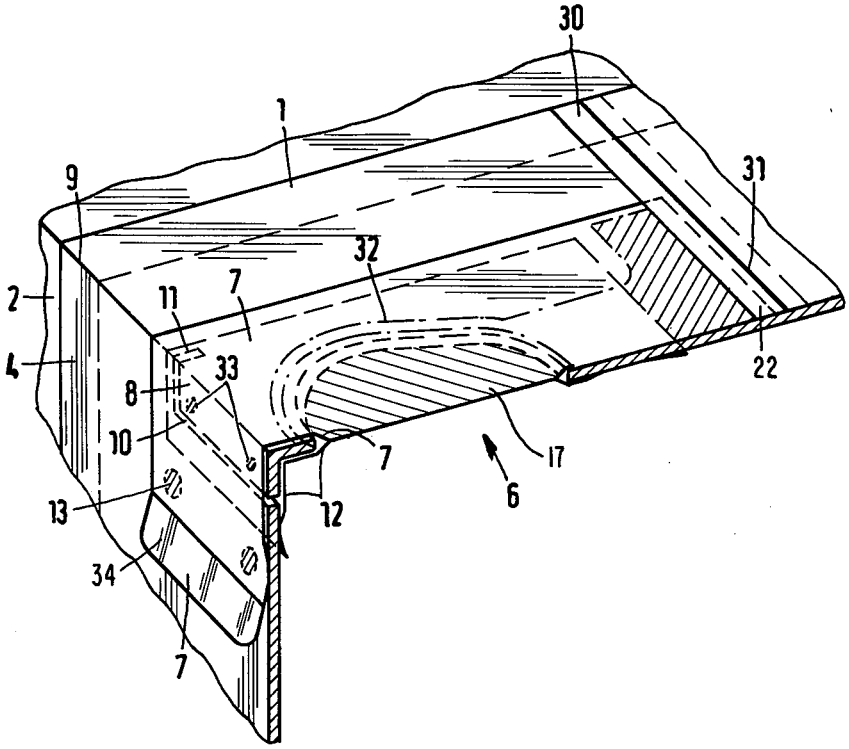
Figure 3:
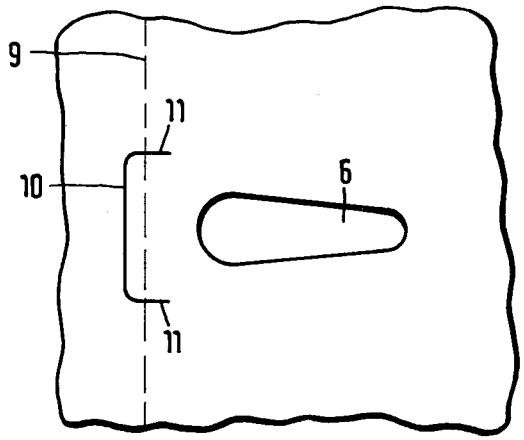
Figure 4:
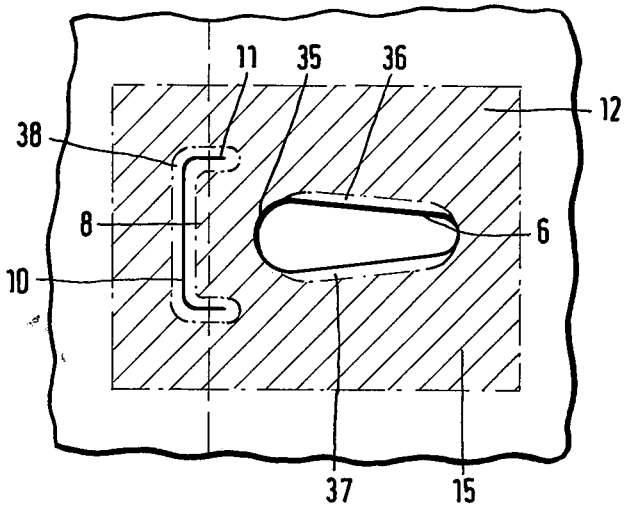
Figure 5:
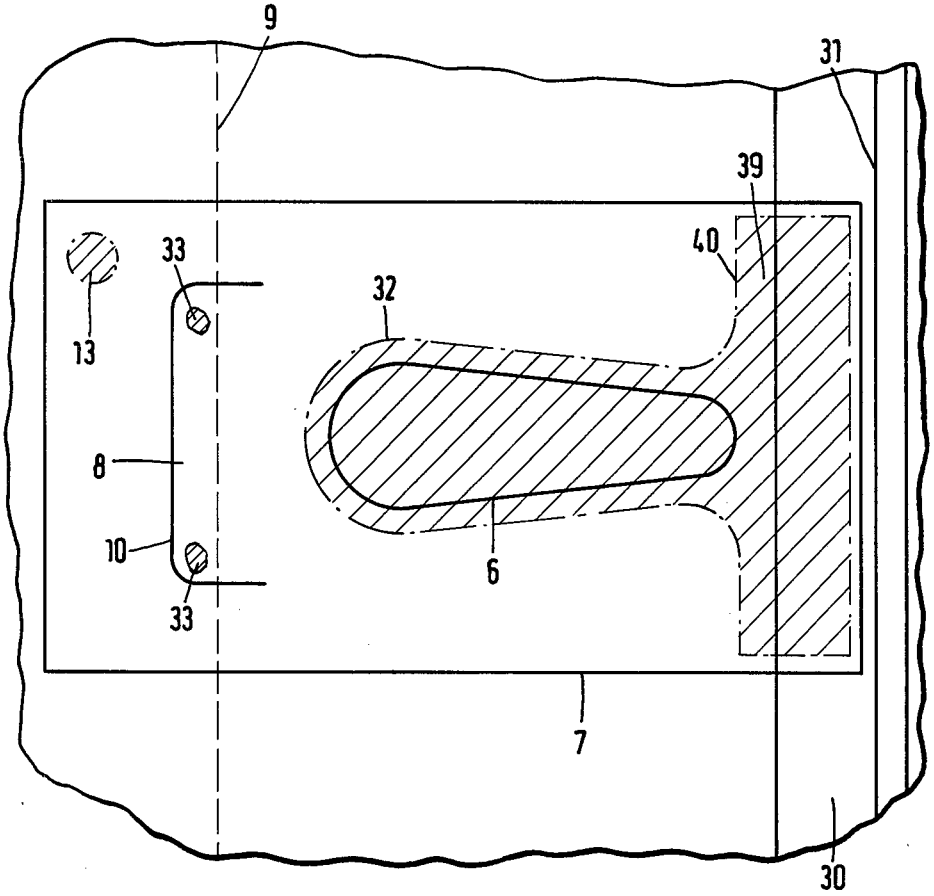

Further advantages, features and possible uses of the present invention will be apparent from the following description in conjunction with the drawings in which:

FIG. 1 shows a liquid packaging means having an opening means according to the invention, FIG. 2 shows a view on an enlarged scale and partly in section of part of the packaging means with the opening means according to the invention, FIG. 3 shows a part which has been cut off the web of material for producing the packaging means, in the region of the opening means at the edge line before the sealing strip and the outer cover strip are welded in place, FIG. 4 shows the same view as that of FIG. 3 but after the inner sealing strip has been welded in place, and FIG. 5 shows the same view as those of FIGS. 3 and 4 but viewed from the outside, after the outer cover strip has been welded in place.

The packaging means shown in FIG. 1 is of the known parallelepipidic shape and is made from a laminate material which has a central main layer of paper or board which is coated on both sides with homogeneous thermoplastic material. The laminate material for the packaging means can also have layers of another material, for example material with good gas barrier properties such as aluminium foil and the like.

The packaging means according to the invention has an upper end wall 1, a narrow side wall 2 and a wide side wall 3, the upper end wall 1 and the narrow side wall 2 being separated from each other by the edge line 9; or the edge line 9 separates a double-layer triangular flap 5 from the upper end wall 1. A closure seam 4 with a transverse seal seam (not shown) extends longitudinally from the tip of one triangular flap 5 shown in FIG. 1, across the upper end wall 1, to the tip of the other triangular flap (not shown) which is folded down on to the other narrow side wall.

The opening means is shown in FIG. 1 in the opened condition, from which it will be clearly seen that it has a substantially oval pouring opening 6, a tear-open outer cover strip 7 and a pouring edge 8 which is defined by a U-shaped slot generally indicated by reference 10. The web portion which joins the two limb portions 11 of the U-shape extends parallel to the edge line 9 and closely adjacent thereto. In the opened condition shown in FIG. 1, the pouring edge is folded upwardly into the plane of the upper end wall 1.

FIG. 2 shows a part of the packaging means illustrated in FIG. 1, more precisely a part of the upper end wall 1, a part of the narrow side wall 2 and the edge line 9. FIG. 2 again shows the pouring opening 6 whose front end is close to the edge line 9 (usually at a distance of from 5 to 10 mm from the edge line). In the embodiment illustrated, the pouring opening 6 is of an oval or drop-like form and is so disposed that its longer axis of symmetry is normal to the edge line 9. This arrangement substantially facilitates pouring the contents of the packaging means through the pouring opening 6 as, when the packaging means is held in an inclined position when pouring out the contents, the contents can flow out through the part of the pouring opening 6 which is closest to the edge line 9, while at the same time air can flow into the packaging means through the opposite part of the pouring opening 6. When the opening means is in the unopened condition shown in FIG. 2, the pouring opening 6 is covered from the outside by the tear-off outer cover strip 7. The cover strip 7 is so provided on the upper end wall 1 that it completely covers the pouring opening 6 and extends beyond the edge line 9 and down along the side wall 2 where it terminates at a certain distance below the edge line 9 in a free end portion 34 which is bent somewhat outwardly away from the side wall 2 and thus serves as a pulling tongue portion for when the packaging means is to be opened. The cover strip 7 is partly joined to the upper end wall 1 in the region 22 in the middle connecting seam 30, but outside of its seal seam 31. FIG. 2 also shows the dash-dotted line 32 within which, around the pouring opening 6, the cover strip 7 is also welded in place. In the region 17, the cover strip 7 is also fixedly welded to the inner sealing strip 12. Finally, the cover strip 7 is also welded to the pouring edge 8 on the exterior, at fastening positions 33, and on the exterior to one side of the triangular flap 5, at the fastening strips 13. Also shown is the U-shaped slot 10 of which one shorter limb portion 11 can also be seen in broken lines.

It is also possible to see the inner sealing strip 12 in this perspective broken-away view, but its sealing regions can be better seen in the following figures.

FIG. 3 shows a broken-away plan view of a part of the coated web of carrier material, approximately in the region of the view shown in FIG. 2, namely including the pouring opening 6, the slot 10 and the edge line 9. In order to produce the opening means according to the invention, the web of carrier material which is coated with a thermoplastic material on both sides is so punched as to form the slot 10 with the two limb portions 11, and the hole-like opening 6.

If then a view is taken on to the inside of the web of packaging material in the region of the edge line 9, as shown in FIG. 3, the resulting view is the view of FIG. 4 with the sealing strip 12 which is welded in place on the inside. The dash-dotted lines define a hatched region 15 which represents the sealing region between the inner plastics coating on the web of carrier material and the sealing strip 12. It will be seen that two weld-free regions 36 and 37 are provided at the right and left sides of the end 35 of the pouring opening 6 which is towards the subsequent pouring edge 8 or the slot 10. A further weld-free region 38 is formed around the U-shaped cut line 10.

The web of packaging material is now turned over in the imagination so that the sealing strip 12 comes to lie underneath and the view is from above on to the outside of the web of material or the packaging means which is subsequently to be formed. The resulting view is then as shown in FIG. 5 a broken-away section including the edge line 9, the U-shaped slot 10 and the pouring opening 6 which is covered from the inside by the sealing strip 12. The rectangle 7 shown is the outer cover strip. It is welded in the region 39 of the hatching defined by the dash-dotted line 40, so that it is also welded to the inner sealing strip 12 within the outline of the pouring opening 6. In addition to this region 39, the cover strip is welded to the top side of the packaging means only at the fastening positions 33 in the region of the pouring edge 8 and at the weld position 13. The other regions remain weld-free.

I claim:

1. In combination, an opening means, and a package made from flexible material, in particular for liquids, having an upper end wall, means defining a pouring opening in the upper end wall adjacent an edge line, and having an openable cover strip which is provided on the outside of the package, characterized in that an approximately U-shaped slot is provided in a side wall adjacent the edge line, to form a pouring edge which projects from the edge line and which can be pivoted forwardly into the plane of the upper end wall, wherein the pouring opening and the slot are provided with a plastics sealing means from the inside of the package, the free ends (11) of the U-shaped slot (10) are arranged to extend by a portion into the upper end wall (1), and the outer cover strip (7) is weld-free almost over the entire pouring edge region (8).

2. An opening means according to claim 1 characterised in that the outer cover strip (7) is joined beside the slot (10, 11) to the pouring edge (8) at at least one weld position (33).

3. An opening means according to claim 1 or claim 2 characterised in that the outer cover strip (7) is welded by its end which is remote from the pouring edge (8) in a seal seam (30, 31) which is approximately in the middle of the upper end wall (1).

4. An opening means according to claim 1 or 2 characterised in that the plastics sealing strip (12) which is sealed on to the inside of the packaging means has regions (36, 37, 38) which are weld-free at the right and left sides of the end (35) of the pouring opening (6) which is towards the pouring edge (8), and around the U-shaped slot (10, 11).

5. An opening means according to claim 1 or 2 characterised in that the outer cover strip (7) is sealed on to the side wall (2) which is adjacent the edge line (9) and/or a triangular flap (5) which adjoins the edge line (9), at at least one weld position (13).

* * * * *